United States Patent [19]

Berry

[11] 4,201,520

[45] May 6, 1980

[54] STEAM TURBINE GOVERNOR

[76] Inventor: Clyde F. Berry, R.F.D. 7 Box 169 C, Manchester, N.H. 03104

[21] Appl. No.: 818,512

[22] Filed: Jul. 25, 1977

[51] Int. Cl.[2] ..... F01B 25/06

[52] U.S. Cl. ..... 417/36; 73/542

[58] Field of Search ..... 415/25, 36; 73/542

[56] References Cited

U.S. PATENT DOCUMENTS

| | | | |
|---|---|---|---|
| 280,984 | 7/1883 | Williames | 73/542 |
| 340,978 | 5/1886 | Casho | 73/542 |
| 982,879 | 1/1911 | Hodgkinson | 415/36 |
| 1,062,099 | 5/1913 | Hoglund | 415/36 |
| 1,066,235 | 7/1913 | Tamassy | 73/542 |
| 1,357,501 | 11/1920 | Lacy | 415/36 |
| 1,533,767 | 4/1925 | Schmidt | 415/36 |
| 2,599,797 | 6/1952 | Wilson | 73/542 |

FOREIGN PATENT DOCUMENTS

| | | | |
|---|---|---|---|
| 6952 | 10/1895 | Sweden | 415/36 |

*Primary Examiner*—William L. Freeh

*Attorney, Agent, or Firm*—C. Yardley Chittick

[57] ABSTRACT

A governor for a steam operated engine by which the steam valve opening for any selected engine speed can be varied to accommodate different steam pressures, or conversely with a constant steam pressure, the steam value opening may be varied to produce any selected engine speed.

4 Claims, 2 Drawing Figures

STEAM TURBINE GOVERNOR

BACKGROUND OF THE INVENTION

Governors for use on steam engines are old and well understood in the art. A governor is a feedback device intended in general to cause the machine to operate at some selected constant speed. For example, if through an increase in steam pressure the machine should accelerate, the governor functions to close the steam valve sufficiently to reduce the speed to the selected constant. Governors are adjustable so that they may be set to produce whatever operating conditions are desired.

SUMMARY OF THE INVENTION

The present invention is a new and novel adjustable governor for use particularly on a steam turbine. The governor controls the position of the steam valve and hence the speed of the turbine at any given steam pressure. Two species of the invention are disclosed herein. In one form, the entire governor is mounted directly on and rotates with the turbine shaft. In a second form, only the fixed weight parts of the governor are mounted on the turbine shaft. The adjustable element, subject to gravity and not to centrifugal force, is associated with a lever intermediate the turbine shaft and the piston that actuates the steam valve.

DESCRIPTION OF A PREFERRED EMBODIMENT

Figure 1:
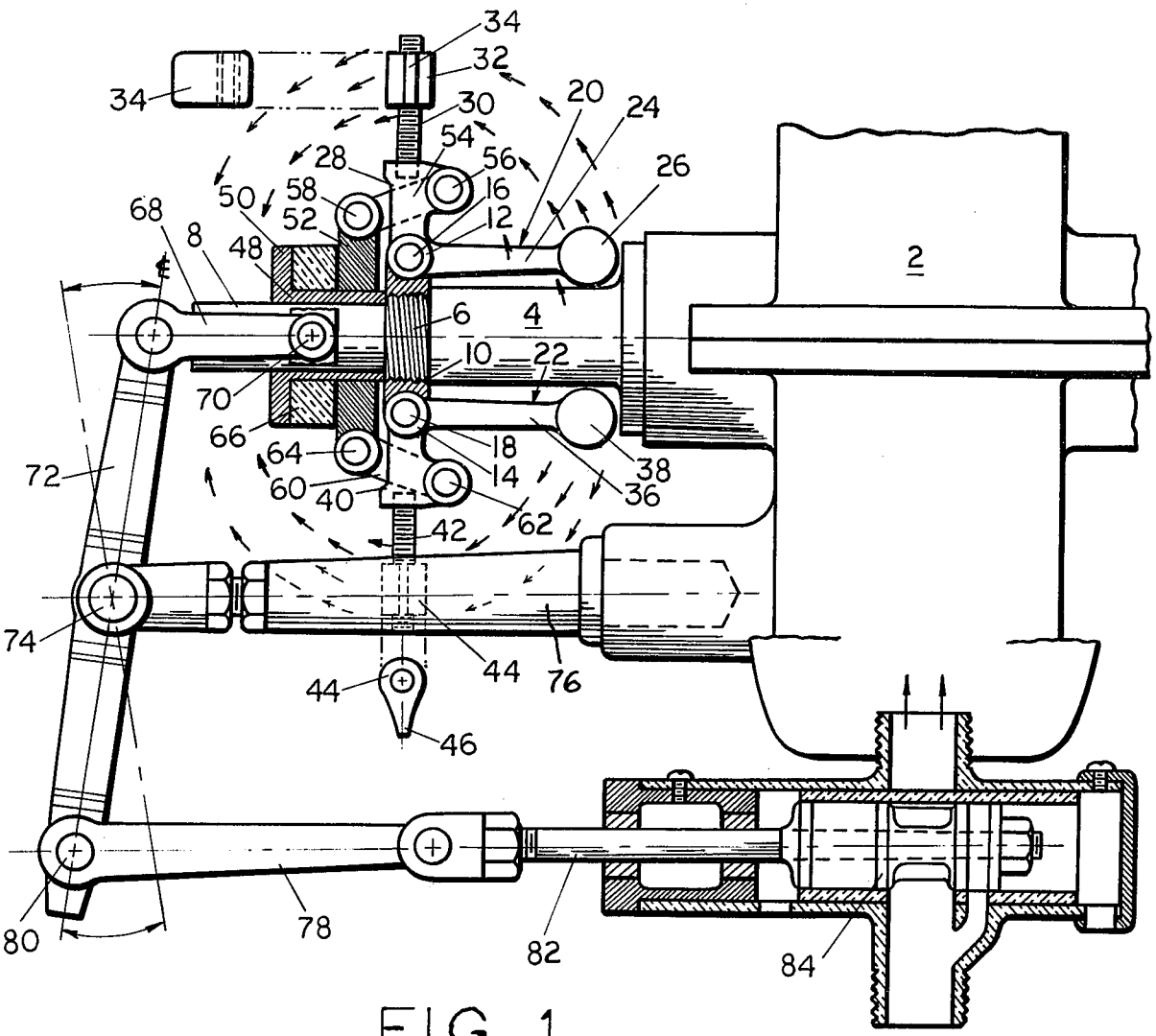
FIG. 1 is partly a vertical section and partly a side elevation of one form of the invention.

In FIG. 1 of the drawings, a turbine is shown at 2 with its shaft 4 extending from the housing. The shaft has a short threaded section 6 of slightly reduced diameter and a further cylindrical extension 8.

A collar 10 is threaded tightly on section 6. Collar 10 carries spaced ears 12 and 14 180° apart which ears support pivots 16 and 18 on which are mounted bell cranks 20 and 22. Bell crank 20 has a first arm 24 carrying at its end a flyweight 26 and a second shorter arm 28 at right angles to arm 24. A threaded shaft 30 extends from arm 28 and has adjustably mounted thereon a second flyweight 32. By rotating weight 32, it may be moved toward or away from pivot 16 along threaded shaft 30.

The weight 32 is eccentrically formed with a vane 34 extending from one side. When the governor is in operation, air pressure against the vane prevents rotation of weight 32 on shaft 30. This eliminates any need for lock nuts to hold weight 32 in any selected position.

Bell crank 22 is similarly equipped with a first arm 36, a flyweight 38, a second arm 40, a threaded shaft 42, and a second adjustable flyweight 44 with a vane 46.

All the parts associated with bell cranks 20 and 22 are of the same dimensions and weights so as to be in dynamic balance when rotated by turbine shaft 4.

Mounted on shaft extension 8 is a bushing 48 with an end flange 50. Bushing 48 is in close sliding engagement with extension 8. A control coupling 52 which may be in the form of a disc or plate has a hole therethrough sized to enable the coupling to make a driving fit with bushing 48. A pair of spaced links 54 straddle arm 28 and make pivoted connection with the arm at 56 and with the coupling at 58. Similar links 60 straddle arm 40, their ends being pivoted to arm 40 at 62 and to coupling 52 at 64.

A floating collar 66 is rotatably mounted on bushing 48 between flange 50 and coupling 52. The separated arms of a yoke 68 are pivotally connected to opposite sides of collar 66, one connection being shown at 70.

The other end of yoke 68 is pivotally connected to the end of a lever 72 whose fulcrum 74 is carried by a fixed support 76 which may extend from some part of the turbine housing. The fixed support 76, it should be noted, is not vertically below turbine shaft 4 but is mounted on part of the turbine housing a sufficient distance toward the viewer of the drawing so as not to interfere with the rotating bell cranks 20 and 22 or the threaded shafts 30 and 42 when they are in their maximum extended positions. The other end of lever 72 is pivotally connected to link 78 at 80. Link 78 is in turn pivotally connected to the piston rod 82 of steam valve 84 of typical construction. The valve is shown in full open position to permit maximum flow of steam to the turbine.

From the foregoing explanation of the structure disclosed in FIG. 1, it will be understood that upon commencement of rotation of the turbine, all of the parts mounted on the turbine shaft with the exception of floating collar 66 will rotate with the shaft. As the turbine speed increases, the arms 24 and 36 will swing away from the shaft while arms 28 and 40 will swing toward the shaft.

The extent of the angular movement of bell cranks 20 and 22 is a function of the speed of rotation of shaft 4 and the mass and location of weights 26, 32, 38, and 44. As the bell cranks are moved about their pivots 16 and 18, the links 54 and 60 push the coupling 52 and the associated bushing 48 and collar 66 to the left along shaft extension 8. This in turn moves lever 72 counterclockwise about pivot 74 to cause piston rod 82 to move to the right to reduce the steam passage through valve 84.

The construction of FIG. 1 described above makes it possible to maintain a substantially contant turbine speed with a fluctuating steam pressure. Conversely, the ability to adjust the position of the weights 32 and 44 on shafts 30 and 42 makes it possible to vary the turbine speed where there is a constant steam pressure. That is, by moving weights 32 and 44 outward on shafts 30 and 42, the bell cranks 20 and 22 will be rotated through a smaller angle for a given speed. Hence the steam valve 84 will be more open for a given steam pressure and the turbine will rotate faster. Conversely, moving the weights 32 and 44 inwardly will cause the steam valve to be closed to a greater extent for the same turbine speed, thus reducing the steam supply and slowing the turbine.

DESCRIPTION OF A SECOND EMBODIMENT

Figure 2:
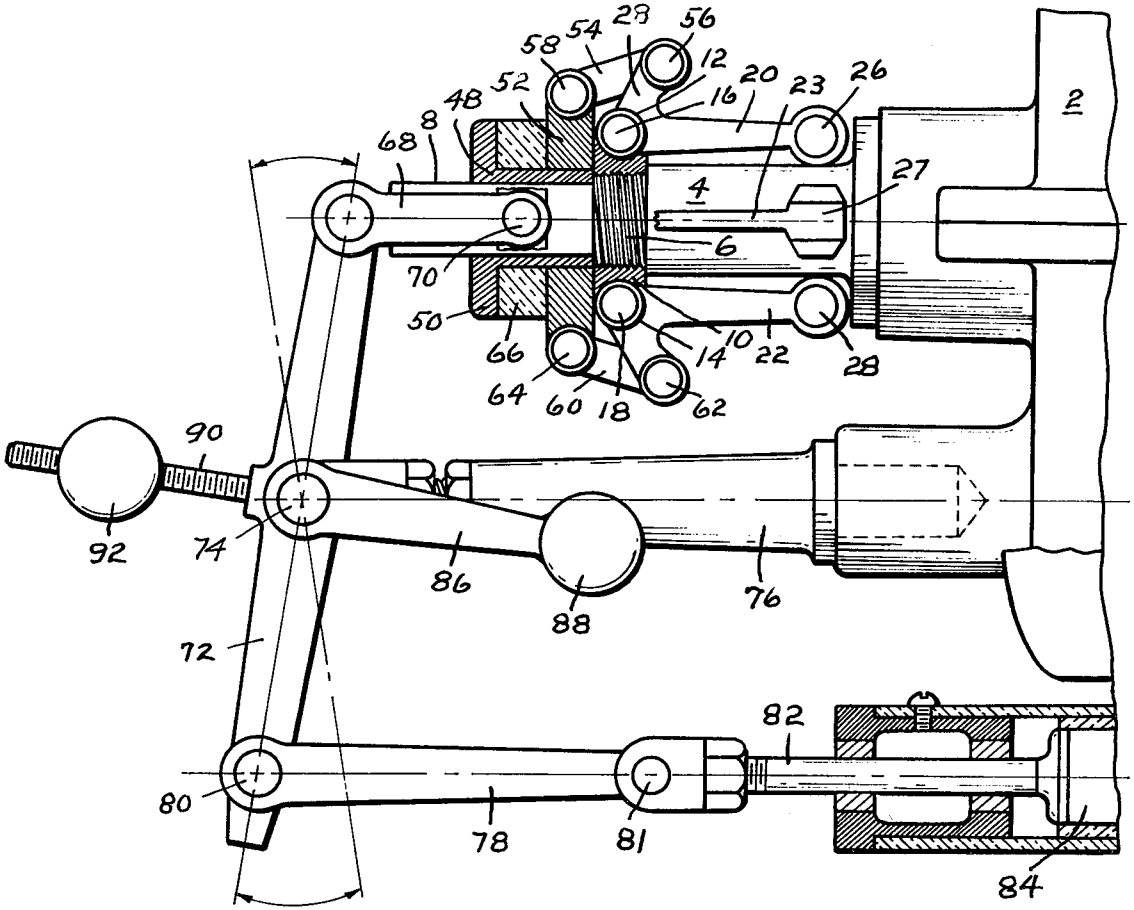
FIG. 2 is partly a vertical section and partly a side elevation of a second form of the invention.

A second form of the invention is shown in FIG. 2. Those parts that are the same as in FIG. 1 have had the same numbers and names applied thereto.

A turbine is shown at 2 with its shaft 4 extending from the housing. The shaft 4 has a short threaded section 6 of slightly reduced diameter and a further cylindrical extension 8.

A collar 10 is threaded tightly on section 6. Collar 10 carries four pair of ears spaced 90° apart, of which two pair 12 and 14 are shown. These ears support pivots such as those indicated at 16 and 18 which pivots carry four bell cranks of which two are shown at 20 and 22 and a third at 23 broken away. The fourth bell crank being on the far side of shaft 4 is not shown. Each bell crank as a long major arm at the end of which is a fixed weight such as weights 26, 27, and 28.

Mounted on shaft extension 8 is a bushing 48 with an end flange 50. Bushing 48 as in FIG. 1 is in close sliding engagement with extension 8. A control coupling 52 which may be in the form of a disc or plate has a hole therethrough sized to enable the coupling to make a driving fit with bushing 48. Four sets of links of which two are shown at 54 and 60 connect the ends of the short arms of the four bell cranks to the coupling 52.

A floating collar 66 is rotatably mounted on bushing 48 between flange 50 and coupling 52. The separated arms of a yoke 68 are pivotally connected to opposite sides of collar 66, one connection being shown at 70.

The other end of yoke 68 is pivotally connected to the end of a lever 72 whose fulcrum 74 is carried by a fixed support 76 which may extend from some part of the turbine housing. The other end of lever 72 is pivotally connected to link 78 at 80. Link 78 is in turn pivotally connected at 81 to the piston rod 82 of steam valve 84 of typical construction. The valve 84 in FIG. 2 is in full open position to permit maximum flow of steam to the turbine.

The control of the governor shown in FIG. 2 is effected by adjustable means connected to lever 72. An arm 86 fixed to lever 72 has a weight 88 mounted on its end of sufficient mass to strongly oppose turning of lever 72 in a counter clockwise direction as the bell cranks swing out as shaft 4 rotates. Extending from the other side of lever 72 in opposition to arm 86 is a threaded rod 90 carrying thereon a weight 92 which may be adjusted toward or away from the pivot 74.

When weight 92 is moved toward the pivot 74, resistance to clockwise turning of lever 72 is decreased. When weight 92 is moved to the left so that the weight 88 is increasingly counterbalanced, less force from the bell cranks is required to move lever 72 counterclockwise.

The operation of the governor of FIG. 2 is as follows. With the parts in the position shown, the main steam valve is opened to cause steam to flow through open valve 84 to put the turbine into rotation. As the shaft 4 speeds up, the four bell crank arms 20, 22, 23 and the one on the opposite side of shaft 4 begin to swing outward about the pivots carried by collar 10. This causes the bushing 48 and yoke 68 to move to the left along shaft extension 8 to cause lever 72 to turn counter clockwise moving valve 84 toward closed position and reducing the steam flow to the turbine. The fixed support 76 in FIG. 2 like the support 76 in FIG. 1, is not located below shaft 4 but is located toward the viewer a sufficient distance to be clear of the bell cranks as they rotate in maximum extended position.

For a given speed of rotation of turbine shaft 4, the extent of movement of valve 84 toward closed position can be controlled. By moving weight 92 to the right so that weight 88 is more dominant, the outward swinging of the crank arms will be reduced and valve 84 will be less closed. As weight 92 is moved to the left along shaft 90, the force opposing the outward swinging of the crank arms will be lessened so that the valve 84 will be more closed for the same turbine speed.

In summary, then, the constructions shown in both FIGS. 1 and 2 provide adjustable mechanical structures which upon suitable calibration for weight positions in relation to the available steam pressure, may be readily set to give any required turbine speed. A principal advantage of the constructions is that the governor may be easily adjusted to provide controlled limited opening of the steam valve thus to provide the required turbine speed over a wide range of steam pressures. The conventional governor moves the steam valve from fully open to completely closed in inverse ratio to the speed. In my constructions, the turbine speed can be controlled under varying or constant steam pressure.

All parts are made of conventional materials.

While this disclosure has been particularly directed to a governor for a steam turbine, it will be understood that the invention is equally applicable to turbines driven by air or other fluid. The terms steam turbine and steam valve are not to be considered as limiting but as representative of the type of mechanism that may be controlled by the governor.

It is intended to cover all changes and modifications of the example of the invention herein chosen for purposes of disclosure which do not constitute departures from the spirit and scope of the invention.

I claim:

1. A steam turbine governor located exteriorly of the turbine housing and comprising a plurality of bell cranks mounted on pivots fixed to and spaced about the turbine shaft, each said crank mounted so as to swing in a plane that extends generally parallel to said shaft, a fixed weight on one arm of each bell crank remote from its said pivot, said turbine shaft having a cylindrical extension beyond said pivots, a bushing slidably mounted on said extension, means including linkages connecting the other arms of said bell cranks with said bushing whereby when said first arms are swung outward by centrifugal force induced by rotation of said shaft, said bushing will rotate with said turbine shaft and will be caused to move axially along said extension, a collar rotatably mounted on said bushing but axially secured thereto, a steam valve, axially movable means for controlling the position of said valve, a pivoted lever located exteriorly of said turbine housing and mounted on means associated with said turbine housing, means connecting the ends of said lever to said axially movable means and to said collar whereby said collar is maintained against rotation on said bushing, means connected to said lever for applying a constant maximum force for resisting the outward swinging of said first arms as said turbine shaft rotates, and other means exterior of said housing and operable while said turbine is running for adjustably diminishing said constant maximum force whereby the position of said steam valve at any given rotational speed of said turbine shaft may be varied.

2. The combination set forth in claim 1, the means for adjustably diminishing said constant maximum force comprising an arm connected to said pivoted lever and having a movable weight thereon, said arm and weight arranged to provide a force tending to move the end of the lever connected to said collar in the direction away from said collar.

3. The combination set forth in claim 1, the means for applying said constant maximum resisting force comprising a weighted arm connected to said pivoted lever and arranged to urge the end of the lever connected to said collar in the direction toward said collar.

4. The combination set forth in claim 3, the means for adjustably diminishing said constant maximum force comprising a second arm connected to said pivoted lever and extending generally oppositely to said weighted arm and a movable weight on said second arm.

* * * * *